US006505555B2

(12) United States Patent
Kanda

(10) Patent No.: US 6,505,555 B2
(45) Date of Patent: Jan. 14, 2003

(54) CYLINDRICAL BLANKET AND BLANKET CYLINDER, AND PRINTING PRESS

(75) Inventor: Yoshiaki Kanda, Hiroshima-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 1 day.

(21) Appl. No.: 09/820,942

(22) Filed: Mar. 30, 2001

(65) Prior Publication Data

US 2002/0011166 A1 Jan. 31, 2002

(30) Foreign Application Priority Data

Jul. 31, 2000 (JP) ..... 2000-231813

(51) Int. Cl.[7] ..... B41N 10/04; B41F 13/08; B41F 30/00

(52) U.S. Cl. ..... 101/217; 101/376; 101/415.1; 101/221; 428/909; 492/56

(58) Field of Search ..... 101/216, 217, 101/375, 376, 415.1, 492, 493, 401.1, DIG. 36, 219, 220, 221, 248; 428/909; 492/54, 56; 29/895.21, 895.23

(56) References Cited

U.S. PATENT DOCUMENTS

| | | | | |
|---|---|---|---|---|
| 2,859,691 A | * | 11/1958 | Heller | 101/177 |
| 4,125,073 A | | 11/1978 | Bain | 101/216 |
| 4,648,318 A | | 3/1987 | Fischer | 101/415.1 |
| 4,738,200 A | | 4/1988 | Stockl et al. | 101/216 |
| 5,038,680 A | * | 8/1991 | Bain | 101/217 |
| 5,351,615 A | * | 10/1994 | Kobler et al. | 101/217 |

FOREIGN PATENT DOCUMENTS

| | | |
|---|---|---|
| EP | 0 571 909 A2 | 12/1993 |
| EP | 0 629 514 A1 | 12/1994 |
| JP | 61-95944 | 5/1986 |
| JP | 61-213157 | 9/1986 |
| JP | 6-24206 | 6/1994 |

OTHER PUBLICATIONS

European Patent Office Communication with European Search Report for corresponding European Patent Application No. 01107851.6–2304 dated Oct. 12, 2001.

* cited by examiner

*Primary Examiner*—Leslie J. Evanisko
(74) *Attorney, Agent, or Firm*—Armstrong, Westerman & Hattori, LLP

(57) ABSTRACT

In the present invention, a blanket cylinder for a printing press is made up of a shaft roller and a cylindrical blanket capable of being attached and detached freely to and from the shaft roller. The cylindrical blanket comprises an elastic layer formed integrally with a cylindrical sleeve by winding and bonding a sheet-form elastic member on and to the outer peripheral surface of the sleeve, the elastic layer having a gap extending in the axial direction formed between both ends in the circumferential direction of the sheet-form elastic member; and a separation preventive member for preventing both ends in the circumferential direction of the sheet-form elastic member from being separated from the sleeve, the separation preventive member being embedded in the gap so as to be thinner than the thickness of the sheet-form elastic member to form a groove in the outer peripheral surface of the elastic layer.

5 Claims, 6 Drawing Sheets

CYLINDRICAL BLANKET AND BLANKET CYLINDER, AND PRINTING PRESS

BACKGROUND OF THE INVENTION AND RELATED ART STATEMENT

1. Field of the Invention

The present invention relates to a printing press such as a multi-color press. In particular, the present invention relates to a construction of a blanket cylinder disposed in each printing unit of the printing press and, more particularly, to a cylindrical blanket that forms an outer peripheral surface of the blanket cylinder.

2. Description of Related Art

An offset rotary press (printing press) is provided with a plurality of printing units corresponding to colors to be printed. Each of the printing units is configured so as to distribute ink appropriately to form a thin ink film in a process in which ink charged in an ink fountain is transferred successively by an ink roller group arranged in a row. The formed ink film is transferred to a press plate wound around a plate cylinder, and after the ink film is transferred to the outer peripheral surface of a blanket cylinder, printing is performed on a web ruining while being brought into contact with the rotating blanket cylinders.

The outer peripheral surface of the blanket cylinder, which consists of an elastic member mainly made of rubber or the like, is liable to be subjected to permanent setting, breakage, and other damage, and therefore may need to be replaced. For this reason, the outer peripheral surface of the blanket cylinder has so far been constructed so as to be removable. FIGS. 3 to 5 are schematic views showing typical constructions of conventional blanket cylinders. These figures show a printing unit capable of doing perfecting (printing on both sides of a web) by disposing the blanket cylinders on both sides of a sheet pass line in an opposed manner.

FIGS. 3(*a*) and 3(*b*) show a construction of a blanket cylinder of a type such that a sheet-form blanket is wound around a basic shaft roller. As shown in these drawing figures., a blanket cylinder 30 is formed with a slit-form groove 16 over the whole length in the axial direction in the outer peripheral surface of a basic shaft roller 24. The blanket cylinder 30 is configured so that both ends in the circumferential direction of a sheet-form blanket 15 are inserted into the groove 16 so as to be held (fixed) by a tightening device 23. A member denoted by reference numeral 12 in FIG. 3(*a*) is a plate cylinder, and a member denoted by reference numeral 13 is a press plate. Both ends in the circumferential direction of the press plate 13 are gripped by a gripping portion 12*a* provided in the outer peripheral surface of the plate cylinder 12 so that the press plate 13 is wound on the outer peripheral surface of the plate cylinder 12. Also, a web 14 runs while being held between the upper and lower blanket cylinders 30, 30.

The blanket cylinder 30 of this type has a problem in that the work efficiency in replacing the blanket 15 is low, so that the replacement work takes much time. Also, the blanket 15 is subjected to a high tension in the vicinity of the tightening device 23 and is less prone to be subjected to a tension in a portion distant from the tightening device 23. Therefore, the blanket cylinder 30 also has a problem in that the thickness of the blanket 15 undesirably changes depending on the tension, so that the initial cylinder accuracy is poor and therefore the printing quality varies. Further, the blanket cylinder 30 also has problems in that rotating vibrations and noise are generated by the slit-form groove 16 opened in the axial direction in the cylinder surface of the tightening device 23, and in that much spoilage is produced because the slit-form groove 16 provides a non-printing portion.

FIGS. 4(*a*), 4(*b*) and 5 show a blanket cylinder of a type such that a cylindrical (sleeve-form) blanket is fitted on a basic shaft roller. As shown in FIGS. 4(*a*) and 4(*b*), a blanket cylinder 31 is configured so that a cylindrical blanket 10 is fitted onto the outer peripheral surface of a basic shaft roller 3. The cylindrical blanket 10 is constructed by integrally fitting a skin layer 17 formed of an elastic material, such as rubber, on a metallic sleeve 8. Also, as shown in FIG. 5, the cylindrical blanket 10 is rotatably supported between frames 5*a*, 5*b* by bearings 6*a*, 6*b* fitted in bushes 7*a*, 7*b*. Therefore, the work for attaching and detaching the cylindrical blanket 10 to and from the shaft roller 3 is performed in the state in which one bearing 6*a* together with the bush 7*a* is once removed from frame 5*a* to form a predetermined space, and thereby the shaft roller 3 is supported on one side by the other bearing 6*b*.

In the end portion of the outer peripheral surface of the shaft roller 3 on the side on which the cylindrical blanket 10 is attached or detached, a plurality of air holes 18 are formed in the circumferential direction. These air holes 18 communicate with an air supply hole 19 formed in the shaft roller 3, and are connected to an air compression source 22 via a pipe 20, a solenoid valve 21, and the like, so that compressed air can be blown out in the radial direction through the air holes 18 at proper timing. The supply of compressed air toward the air holes 18 forms a compressed air layer in a gap between the shaft roller 3 and the cylindrical blanket 10. This compressed air layer increases the inside diameter of the cylindrical blanket 10 so that the cylindrical blanket 10 can be attached and detached easily to and from the shaft roller 3. The inside diameter of the cylindrical blanket 10 is formed so as to be slightly smaller than the outside diameter of the shaft roller 3. At the time of operation after fitting, therefore, the supply of compressed air is stopped, by which the cylindrical blanket 10 is contracted so as to come into close contact with the shaft roller 3.

For the blanket cylinder 31 of this type having the above-described configuration, the formation of the slit-form groove 16 in the outer peripheral surface of the shaft roller 3, which is necessary for the before-mentioned blanket cylinder 30, is unnecessary, and the time taken for the blanket to be replaced can be shortened. Also, since there is no joint on the surface of the blanket 10, a non-printing portion on the. blanket cylinder 31 is eliminated, and the non-printing portion is decreased to only the range of a portion where the press plate 13 is fitted to the plate cylinder 12, by which spoilage can be decreased. Also, since there is no joint on the surface and variations in thickness of blanket are small, the cylinder accuracy is increased so that vibration noise is reduced, and also the printing quality is stabilized from the early stage.

When the web 14 passes through the printing units successively, ink and moistening water are supplied to the web 14, so that the moisture content of the web 14 increases gradually, with the result that the web 14 becomes liable to elongate in the running direction. In the rotary press for doing multi-color printing by arranging a plurality of printing units, therefore, the elongation is accumulated increasingly toward the downstream side, so that the tension acting on the web 14 tends to decrease gradually.

To cope with this problem, a method can be conceived in which as shown in FIG. 6, for example, the diameters $D_1$, $D_2$ and $D_3$ of blanket cylinders 31, 32, and 33 are relatively increased successively toward the downstream side in the running direction of the web 14 ($D_1<D_2<D_3$) and the peripheral speeds $V_1$, $V_2$ and $V_3$ of the blanket cylinders 31, 32 and 33 are slightly increased successively ($V_1<V_2<V_3$), by which the elongation of the web 14 is absorbed to prevent the decrease in the tension. Also, a method can be conceived in which the rubber material on the outer peripheral surface of each blanket cylinder is made of a material having different paper feed characteristics, and the decrease in the tension is prevented by changing the paper feed characteristics without changing the diameters of the blanket cylinders.

In the aforementioned blanket cylinder 30 shown in FIGS. 3(*a*) AND 3(*b*), an undersheet is interposed between the shaft roller 3 and the sheet-form blanket 15, and by changing the thickness of the undersheet, the diameter of the blanket can be changed relatively easily. Further, even if a fluctuation in web tension level occurs between colors, the web tension is easily equalized because a tension drop occurs for each rotation in the portion of the slit-form groove 16 formed in the outer peripheral surface of the shaft roller 24.

In the blanket cylinder 31 shown in FIGS. 4(*a*) and 4(*b*), since there is no joint on the outer peripheral surface of the cylindrical blanket 10, the equalization of web tension caused by tension drop, as in the above-described blanket cylinder 30, cannot be expected. Also, since the cylindrical blanket 10 is manufactured by integrating the metallic sleeve 8 with the skin layer 17 formed of an elastic material, in order to change the diameter of the blanket cylinder 31, the thickness of the skin layer 17 must be changed. Alternatively, when the diameter of the blanket cylinder 31 is unchanged, the characteristics (paper feed characteristics) of the skin layer 17 must be changed.

Thereupon, in the rotary press equipped with the aforementioned blanket cylinder 31, cylindrical blankets 10 with different diameters or characteristics must be prepared for each color (for each printing unit), so that interchangeability of the cylindrical blankets 10 between the blanket cylinders 31 is lost. As a result, not only the stocks of spare parts increase and therefore the storage space increases, but also the manufacturing cost of individual cylindrical blanket 10 becomes high.

SUMMARY OF THE INVENTION

The present invention has been made to solve the above problems, and accordingly an object thereof is to provide a cylindrical blanket and a blanket cylinder, and a printing press, in which when multi-color printing is done on a running web by using a plurality of printing units arranged in a row, web tension in the running direction can be made uniform while vibrations and noise are restrained.

To achieve the above object, a cylindrical blanket in accordance with the present invention comprises a cylindrical sleeve; an elastic layer formed integrally with the sleeve by winding and bonding a sheet-form elastic member on and to the outer peripheral surface of the sleeve, the elastic layer having a gap extending in the axial direction formed between both ends in the circumferential direction of the sheet-form elastic member; and a separation preventive member for preventing both ends in the circumferential direction of the sheet-form elastic member from being separated from the sleeve, the separation preventive member being embedded in the gap so as to be thinner than the thickness of the sheet-form elastic member to form a groove in the outer peripheral surface of the elastic layer.

Preferably, the separation preventive member is an elastic member.

Also, a blanket cylinder in accordance with the present invention comprises a cylindrical blanket described above; and a shaft roller on which the cylindrical blanket is fitted, the cylindrical blanket being configured so as to be attached and detached freely to and from the shaft roller.

Also, a printing press in accordance with the present invention is configured so that a plurality of printing units are arranged in a row along a running line of a web to do printing on the web by using the printing units, the printing units each being fitted with a blanket cylinder described above. In particular, when perfecting is done, that is, when a pair of the blanket cylinders are arranged on the opposite sides of the running line of the web, the phase relation of the blanket cylinders is preferably established so that grooves formed in the outer peripheral surfaces of the paired blanket cylinders face each other on the running line of the web.

As described above in detail, according to the cylindrical blanket in accordance with the present invention, the groove extending in the axial direction is formed in the elastic layer formed on the outer peripheral surface of the cylindrical sleeve. Therefore, the cylindrical blanket has an effect that when the cylindrical blanket is disposed in each printing unit for a rotary press for multi-color printing, web tension in the running direction can be made uniform, and the cylinder accuracy can be increased by the integration of the elastic layer with the sleeve, so that the occurrence of vibrations and noise can be restrained.

In particular, since the elastic layer is formed by winding and bonding the sheet-form elastic member on and to the outer peripheral surface of sleeve, and the groove is formed by providing the gap between both ends in the circumferential direction of the sheet-form elastic member, the cylindrical blanket also has an effect that the manufacture can be made easily and the manufacturing cost can be saved. Also, in this case, the cylindrical blanket has an effect that both ends in the circumferential direction of the sheet-form elastic member can be prevented from being separated from the sleeve by embedding the separation preventive member the thickness of which is smaller than the thickness of the sheet-form elastic member in the gap, so that the frequency of replacement due to expired service life can be reduced.

Also, according to the blanket cylinder in accordance with the present invention, the above-described cylindrical blanket can be attached and detached freely to and from the shaft roller. Therefore, the blanket cylinder has an effect that the cylindrical blanket can be replaced easily, in addition to the effects achieved by the cylindrical blanket.

Also, according to the printing press in accordance with the present invention, the above-described blanket cylinder is disposed in each printing unit, by which web tension can be made uniform on the upstream and downstream sides of the blanket cylinder. Therefore, the printing press has an effect that the cylindrical blankets with different specifications such as diameter and paper feed characteristics need not be prepared, and only the cylindrical blankets with single specifications suffice. In particular, when perfecting is done, the printing press has an effect that a tension drop is made great and thereby the web tension can be made further uniform by establishing the phase relation of the blanket cylinders so that grooves formed in the outer peripheral surfaces of the paired blanket cylinders face each other on the running line of the web.

DETAILED DESCRIPTION OF PREFERRED EMBODIMENTS

An embodiment of the present invention will now be described with reference to the accompanying drawings.

Figure 1A:
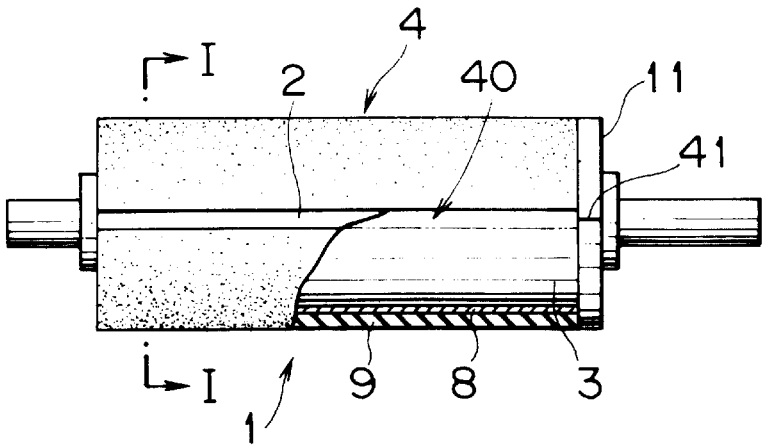
FIGS. 1(*a*) and 1(*b*) are views showing a construction of a blanket cylinder in accordance with one embodiment of the present invention, FIG. 1(*a*) being a partially broken front view of the blanket cylinder taken in the running direction (front direction) of a web, and FIG. 1(*b*) being a sectional view taken along the line I—I of FIG. 1(*a*), in which a shaft roller is omitted.
Figure 1B:
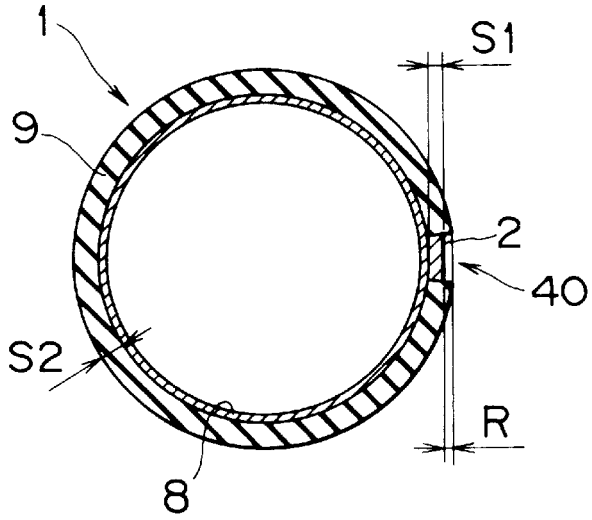
Figure 2A:
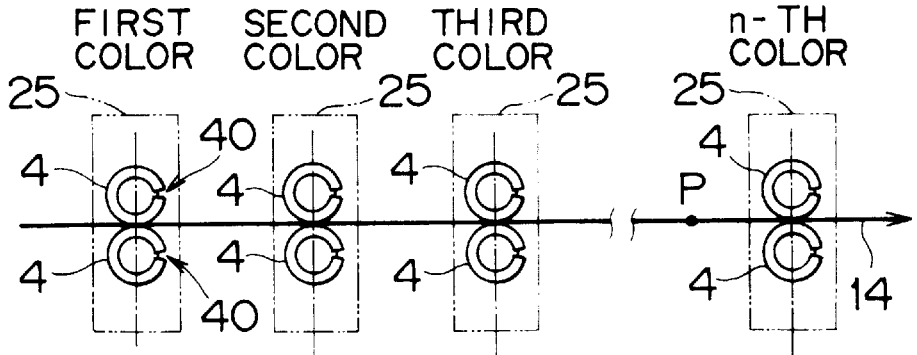
FIGS. 2(*a*) through 2(*d*) are explanatory views for illustrating the operation of a rotary press in accordance with one embodiment of the present invention, FIG. 2(*a*) being a view showing the arrangement of blanket cylinders on a web running line, FIGS. 2(*b*) and 2(*c*) being charts showing tension conditions of web on the running line, and FIG. 2(*d*) being a chart showing a change in web tension with time at a particular point P.
Figure 2B:
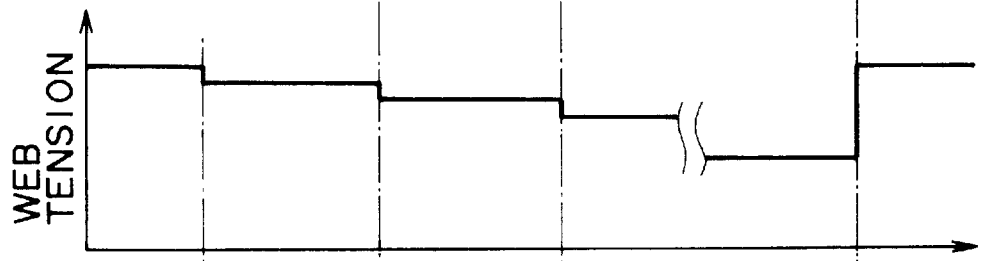
Figure 2C:
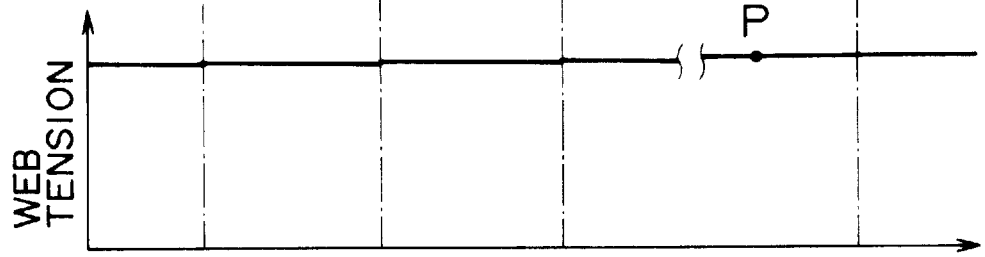
Figure 2D:
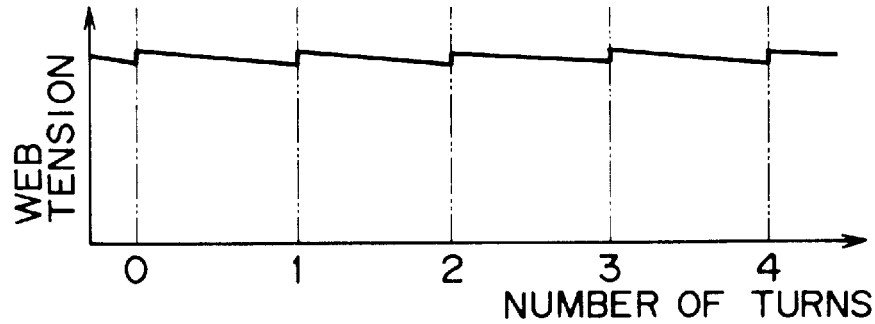

FIGS. 1 and 2 show one embodiment of the present invention. FIG. 1 is a view showing a construction of a blanket cylinder in accordance with this embodiment, FIG. 1(*a*) being a partially broken front view of the blanket cylinder taken in the running direction (front direction) of a web, and FIG. 1(*b*) being a sectional view taken along the line I—I of FIG. 1(*a*), in which a shaft roller is omitted, that is, a sectional view of a cylindrical blanket taken in the axial direction.

A blanket cylinder 4 in accordance with this embodiment is, as shown in FIG. 1(*a*), made up of a basic shaft roller 3 forming an inside cylinder and a cylindrical blanket 1 forming an outside cylinder. The shaft roller 3 and the cylindrical blanket 1 are separate elements, and they are configured so that the cylindrical blanket 1 can be attached and detached to and from the shaft roller 3 by being slid in the axial direction of the shaft roller 3. At one end in the axial direction of the outer peripheral surface of the shaft roller 3 is formed a flange 11, and this flange 11 serves as a stopper to regulate the axial position of the cylindrical blanket 1. Although not shown in the figure, at the end at which the flange is not formed, a plurality of air holes are drilled in the outer peripheral surface of the shaft roller 3, as in the case of the conventional blanket cylinder. When the cylindrical blanket 1 is attached or detached, compressed air is blown through these air holes as in the case of the conventional blanket cylinder, so that the inside diameter of the cylindrical blanket 1 is expanded to facilitate the attachment and detachment of the cylindrical blanket 1 to and from the shaft roller 3.

As shown in FIGS. 1(*a*) and 1(*b*), the cylindrical blanket 1 in accordance with this embodiment is composed of a metallic sleeve 8 forming an inside cylinder and a sheet-form elastic element 9 forming an outer peripheral surface. The metallic sleeve 8 is formed so that the inside diameter dimension is slightly smaller than the outside diameter of the shaft roller 3 as in the case of the conventional cylindrical blanket. Therefore, after the cylindrical blanket 1 is attached to the shaftroller 3, by tightening the shaft roller 3 from the periphery, the metallic sleeve 8 is prevented from shifting in the direction of rotation and in the axial direction after being attached to the shaft roller 3. The sheet-form elastic element 9 is a sheet-form member having a multi-layer construction consisting of a surface rubber layer, foundation cloth layer, foam layer, and the like. After a fabric layer is wound on the outer peripheral surface of the metallic sleeve 8, the sheet-form elastic element 9 is wound on the metallic sleeve 8 in the following process and is bonded thereto with an adhesive or the like, by which the sheet-form elastic element 9 is integrated with the metallic sleeve 8. Also, the outer peripheral surface of the sheet-form elastic element 9 is ground so that a predetermined diameter is provided after being integrated with the metallic sleeve 8.

The circumferential length of the sheet-form elastic element 9 is set so as to be slightly shorter than the circumferential length of the outer peripheral surface of the metallic sleeve 8. Therefore, when the sheet-form elastic element 9 is mounted on the outer peripheral surface of the metallic sleeve 8, a gap (joint) 40 extending in the axial direction is formed between the ends in the circumferential direction of the sheet-form elastic element 9. In the joint 40 is embedded a sheet-form member (separation preventive member) 2. The separation preventive member 2, which serves to prevent both ends of the sheet-form elastic element 9 from being separated from the metallic sleeve 8, is bonded to the outer peripheral surface of the metallic sleeve 8 and to both end portions of the sheet-form elastic element 9. The thickness S1 of the separation preventive member 2 is set so as to be smaller than the thickness S2 of the sheet-form elastic element 9, so that a groove with a depth R (=S2−S1) is formed in the joint 40. Specifically, a groove is formed in the outer peripheral surface of the sheet-form elastic element 9 by embedding in the joint 40 the separation preventive member 2 that is thinner than the sheet-form elastic element 9. The material used for the separation preventive member 2 can be the same as that for the sheet-form elastic element 9.

Figure 5:
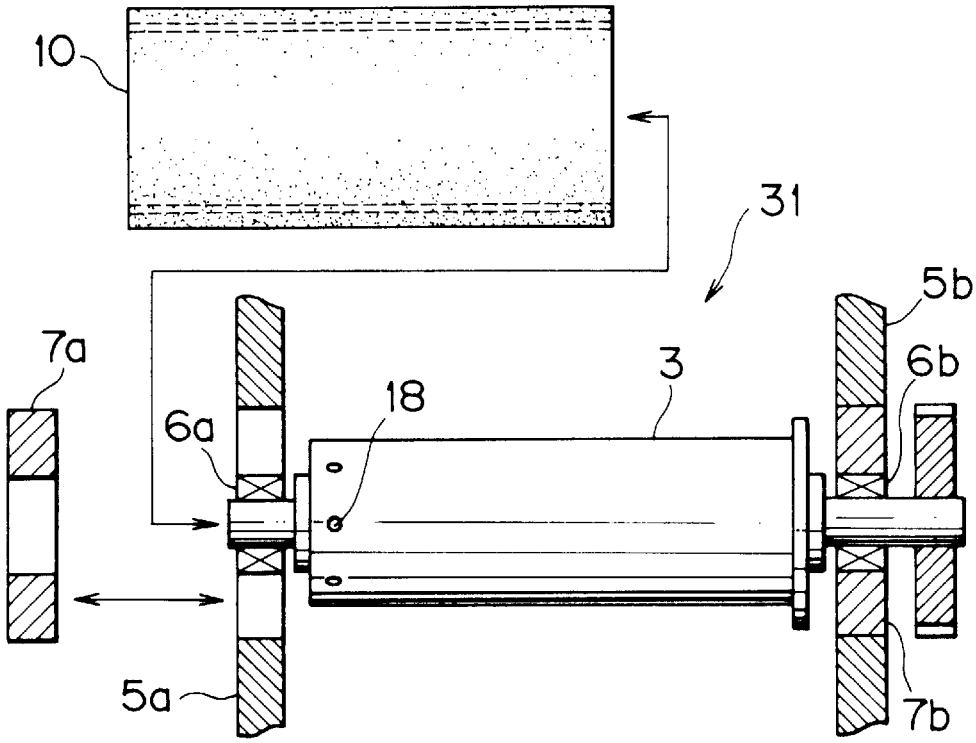
FIG. 5 PRIOR ART
FIG. 5 is an explanatory view for illustrating a method for replacing a cylindrical blanket in the blanket cylinder shown in FIGS. 4(*a*) and 4(*b*)
Figure 6:
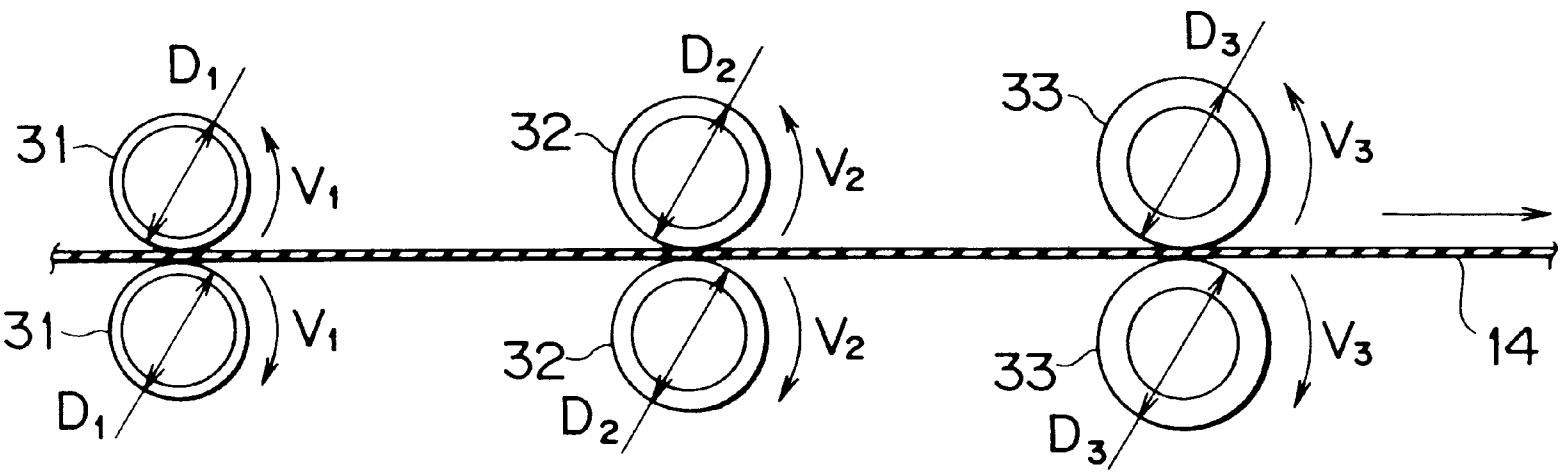
FIG. 6 PRIOR ART
FIG. 6 is a view showing the arrangement of blanket cylinders, which is a view for illustrating a problem with a conventional multi-color rotary press.

By the above-described configuration, for the blanket cylinder 4, the work for replacing the cylindrical blanket 1 with respect to the shaft roller 3 can be performed by the same method as that for the conventional blanket cylinder. Specifically, referring to FIG. 5, a bush 7*a* in which one bearing 6*a* for pivotally supporting the shaft roller 3 is fitted is first removed from one frame 5*a*, by which a predetermined space enough to attach and detach the cylindrical blanket 1 to and from the shaft roller 3 in the axial direction is formed. While the shaft roller 3 is supported on one side by the other bearing 6*b*, the old cylindrical blanket 1 is removed from the shaft roller 3 in the axial direction, and then a new cylindrical blanket 1 is attached to the shaft roller 3. Subsequently, the removed bush 7*a* is mounted in a frame 5*a* and assembled into the original form, by which the replacement work is finished.

Figure 3A:
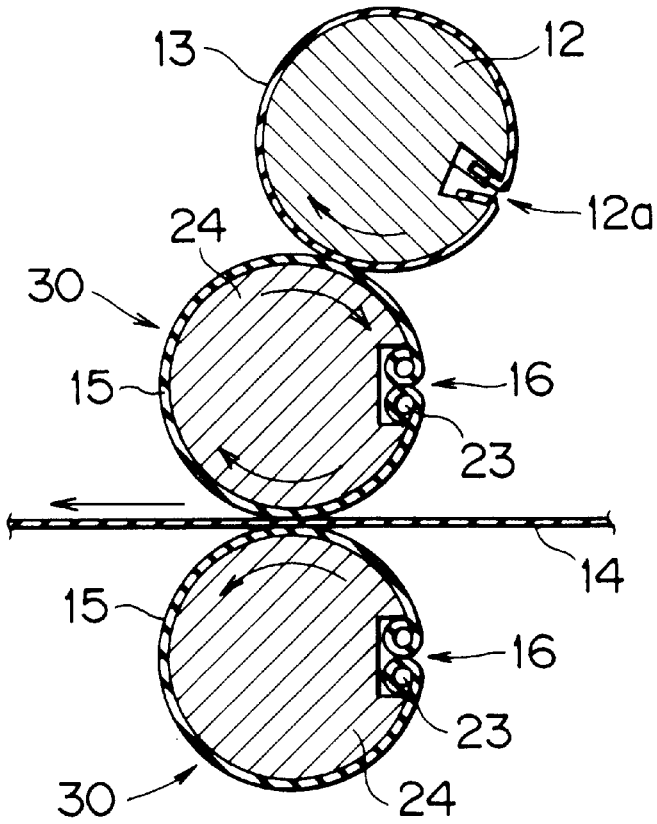
FIG. 3(a) PRIOR ART
FIGS. 3(*a*) and 3(*b*) are schematic views showing a typical construction of a conventional blanket cylinder, FIG. 3(*a*) being a sectional view taken in the axial direction, and FIG. 3(*b*) being an outside view (partially in cross section) taken in the front direction.
Figure 3B:
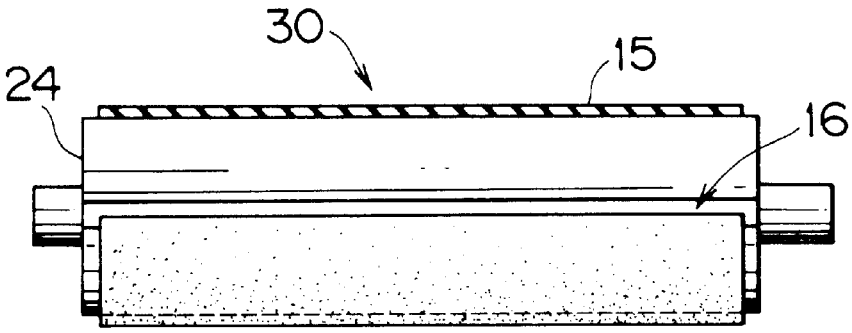
FIG. 3(b) PRIOR ART
Figure 4A:
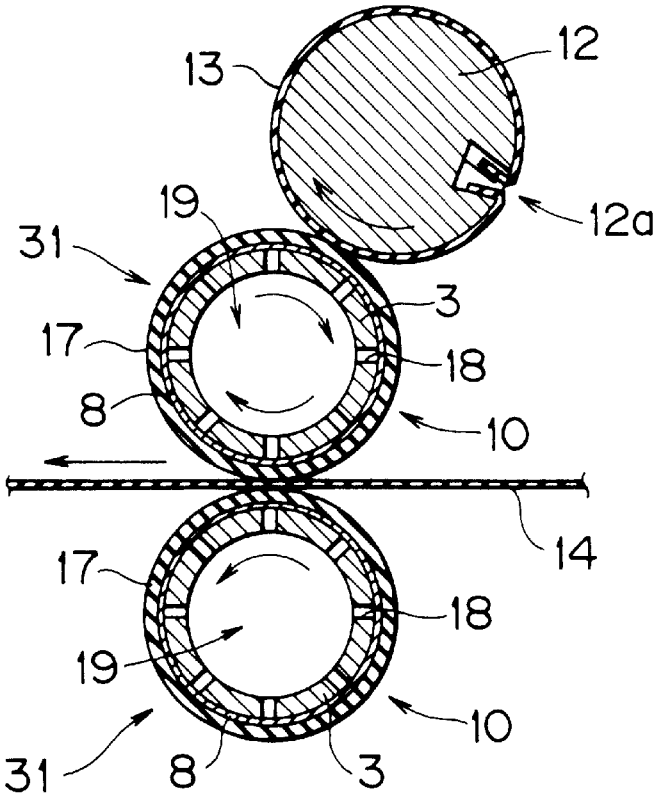
FIG. 4(a) PRIOR ART
FIGS. 4(*a*) and 4(*b*) are schematic views showing another typical construction of a conventional blanket cylinder, FIG. 4(*a*) being a sectional view taken in the axial direction, and FIG. 4(*b*) being a sectional view taken in the front direction.
Figure 4B:
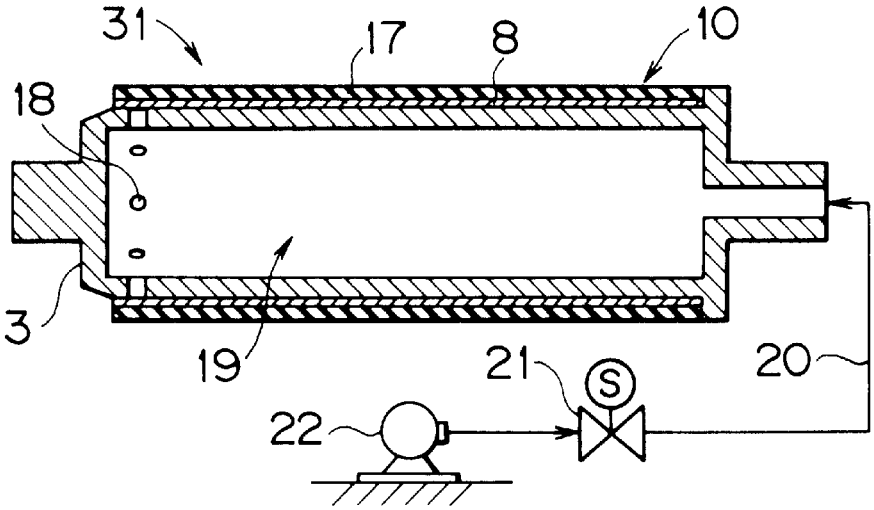
FIG. 4(b) PRIOR ART

As described above, the joint 40 extending in the axial direction is formed in the outer peripheral surface of the cylindrical blanket 1. In order to prevent the joint 40 from coming to a printing pattern surface of a press plate, it is necessary to exactly adjust the phase relation between the joint 40 and the gripping portion (see reference numeral 12*a* in FIGS. 3 and 4) of the press plate so that the joint 40 coincides with (faces) the gripping portion of the press plate formed in the outer peripheral surface of the plate cylinder during the rotation. In this embodiment, therefore, a marking line 41 is provided on the outer peripheral surface of the flange 11 of the shaft roller 3 as a reference line for mounting, and the cylindrical blanket 1 is attached to the shaft roller 3 so that the joint 40 coincides with the marking line 41, whereby the cylindrical blanket 1 is located in a correct phase position.

Next, the operation and effects achieved when the blanket cylinder 4 in accordance with one embodiment of the present invention configured as described above is provided on a rotary press (printing press) for multi-color printing will be described with reference to FIG. 2. FIG. 2 is an explanatory view for illustrating the operation of the rotary press in accordance with this embodiment, FIG. 2(*a*) being a view showing the arrangement of blanket cylinders on a web running line, FIGS. 2(*b*) and 2(*c*) being charts showing tension conditions of a web on the running line, and FIG. 2(*d*) being a chart showing a change in web tension with time at a particular point P.

First, the arrangement of the rotary press for performing multi-color printing will be described. When multi-color printing is done, as shown in FIG. 2(*a*), a plurality of printing units 25 corresponding to the colors to be printed are arranged in a row along the running line of the web 14, and the aforementioned blanket cylinder 4 is disposed for each printing unit 25. FIG. 2(*a*) shows an arrangement in the case where perfecting is done. In this case, a pair of upper and lower blanket cylinders 4, 4 are arranged on the opposite sides of the running line. The upper and lower blanket cylinders 4, 4 are rotated synchronously. In this embodiment, the phase relation between the blanket cylinders 4, 4 is established so that the joints 40 formed on the outer peripheral surfaces of the blanket cylinders 4, 4 face each other on the running line for each rotation.

As described above, when multi-color printing is done, the web 14 is supplied with moistening water together with ink each time printing is overlapped through the plural printing units, so that the web 14 changes in physical properties and gradually becomes liable to elongate. Therefore, when the blanket cylinders of the printing units have an outer peripheral surface with the same paper feed characteristics and also have the same diameter, the tension of the web 14 decreases gradually toward the downstream side in the running direction as shown in FIG. 2(*b*) as the elongation of the web 14 increases.

However, in the rotary press in accordance with this embodiment, the blanket cylinders 4 disposed on the printing units 25, though having the same paper feed characteristics and the same diameter, each are formed with the joint 40 extending in the axial direction in the peripheral surface thereof. Since the portion of joint 40 is depressed to the inside of other outer peripheral surface of the blanket cylinder 4, the engagement of the blanket cylinder 4 with the web 14 weakens momentarily when the blanket cylinder 4 rotates and the joint 40 faces the web 14. Therefore, when there is a difference in tension on the web 14 between the upstream side and the downstream side, a tension drop occurs in the portion of joint 40, so that the tension momentarily becomes equal on the upstream and downstream sides.

In particular, in this embodiment, since the joints 40 formed in the outer peripheral surfaces of the blanket cylinders 4, 4 face each other on the running line of the web 14 for each rotation, the tension drop of the web 14 is great, so that the difference in tension between the upstream side and the downstream side of the blanket cylinder 4 becomes small as shown in FIG. 2(*c*). Also, FIG. 2(*d*) is a chart showing a change in web tension with time at point P in FIG. 2(*a*). As shown in FIG. 2(*d*), a tension drop occurs when the blanket cylinders 4 rotate one turn and the joints 40 face each other (depending on the tension generation mechanism in the periphery), so that the web tension at this time becomes at least a value approximate to the mean value of tensions before and behind the joint 40. That is to say, the tension on the web 14 does not decrease greatly, and unlike the conventional printing unit, a printing trouble is not developed by great winding caused when the web 14 separates from the blanket cylinder 4.

Thus, in this rotary press, even when all of the cylindrical blankets 1 mounted on the blanket cylinders 4 have the same diameter and the same characteristics, no trouble is developed by a change in web tension. Therefore, the present invention has an effect that the cylindrical blankets 1 with different specifications need not be prepared, so that the number of spare parts can be made small, and the storage space and cost can be saved. Also, the present invention has an effect that the use of cylindrical blankets 1 with single specifications eliminates mistaken attachment and check time.

Further, according to the blanket cylinder 4 in accordance with this embodiment, the present invention has an effect that although vibrations and noise increase slightly as compared with the before-mentioned conventional blanket cylinder in which the cylindrical blanket 10 without a joint is used, the increase in vibrations and noise can be made low because of the high cylinder accuracy and the small change in diameter in addition to the decreased width of joint as compared with the conventional blanket cylinder in which the sheet-form blanket 15 is simply wound.

Also, the present invention has an effect that because being constructed by bonding the sheet-form elastic element 9 to the metallic sleeve 8, the cylindrical blanket I can be manufactured at a low cost as compared with the conventional cylindrical blanket 10 having a perfectly cylindrical shape.

The above is a description of one embodiment of the present invention, and various changes and modifications can be made without departing from the spirit and scope of the invention. For example, in the above-described embodiment, the cylindrical blanket 1 is manufactured by bonding the sheet-form elastic element 9 to the metallic sleeve 8, and the joint 40 is formed in the outer peripheral surface thereof. However, the construction may be such that an elastic layer is formed integrally on the outer peripheral surface of the metallic sleeve 8, and a groove extending in the axial direction is formed in the elastic layer. Therefore, a groove extending in the axial direction may be formed by fabricating the outer peripheral surface of the conventional cylindrical blanket 10 having a perfectly cylindrical shape. In this case as well,the increase in vibrations and noise can be made relatively low because the groove width can be set arbitrarily and the cylinder accuracy is high, as compared with the conventional blanket cylinder in which the sheet-form blanket 15 is simply wound.

What is claimed is:

1. A cylindrical blanket comprising:

a cylindrical sleeve;

an elastic layer disposed integrally with said sleeve by winding and bonding a sheet-form elastic member on and to the outer peripheral surface of said sleeve, said elastic layer having a circumferential length which is less that of said sleeve to thereby form a gap extending in the axial direction between both circumferential ends of said sheet-form elastic member; and a separation preventive member for preventing both ends in the circumferential direction of said sheet-form elastic member from being separated from said sleeve, said separation preventive member being disposed in said gap having a thickness thinner than the thickness of said sheet-form elastic member to form a groove in the outer peripheral surface of said elastic layer in which a portion of the ends of said sheet-form elastic member are exposed.

2. The cylindrical blanket according to claim 1, wherein said separation preventive member is an elastic member.

3. A blanket cylinder comprising:

a cylindrical blanket according to any one of claims 1 or 2; and a shaft roller on which said cylindrical blanket is fitted, said cylindrical blanket being configured so as to be freely attached to, and detached from, said shaft roller.

4. A printing press in which a plurality of printing units are arranged along a running line of a web to do printing on said web by using said printing units, said printing units each being fitted with a blanket cylinder according to claim 3.

5. The printing press according to claim 4, wherein a pair of said blanket cylinders are arranged on the opposite sides of the running line of said web, and the phase relation of said blanket cylinders is established so that grooves formed in the outer peripheral surfaces of said paired blanket cylinders face each other on the running line of said web.

* * * * *